US007495571B2

(12) United States Patent
Charren et al.

(10) Patent No.: US 7,495,571 B2
(45) Date of Patent: Feb. 24, 2009

(54) LOST PERSON NOTIFICATION SYSTEM

(76) Inventors: Art Charren, 616 Overbrook Rd., Baltimore, MD (US) 21212; Robert E. Glaser, 3213 Patmor Rd., Owings Mills, MD (US) 21117

( * ) Notice: Subject to any disclaimer, the term of this patent is extended or adjusted under 35 U.S.C. 154(b) by 297 days.

(21) Appl. No.: 10/767,592

(22) Filed: Jan. 28, 2004

(65) Prior Publication Data

US 2005/0012624 A1 Jan. 20, 2005

Related U.S. Application Data

(60) Provisional application No. 60/487,552, filed on Jul. 15, 2003.

(51) Int. Cl.
*G08B 23/00* (2006.01)

(52) U.S. Cl. ..... 340/573.4; 340/7.5; 340/691.6

(58) Field of Classification Search ..... 340/691.6, 340/573.4, 7.5, 7.51
See application file for complete search history.

(56) References Cited

U.S. PATENT DOCUMENTS

| | | | | |
|---|---|---|---|---|
| 5,337,041 | A | 8/1994 | Friedman | |
| 5,561,412 | A | 10/1996 | Novak | |
| 5,633,621 | A | 5/1997 | McDonald | |
| 5,686,886 | A | 11/1997 | Stensney | |
| 5,955,952 | A * | 9/1999 | Bergman et al. | 340/573.1 |
| 5,978,493 | A * | 11/1999 | Kravitz et al. | 382/115 |
| 6,034,605 | A * | 3/2000 | March | 340/573.1 |
| 6,078,282 | A * | 6/2000 | Casey | 701/208 |
| 6,396,403 | B1 * | 5/2002 | Haner | 340/573.4 |
| 6,449,611 | B1 * | 9/2002 | Frankel et al. | 707/6 |
| 6,698,653 | B1 * | 3/2004 | Diamond et al. | 235/375 |
| 6,842,774 | B1 * | 1/2005 | Piccioni | 709/207 |
| 6,847,295 | B1 * | 1/2005 | Taliaferro et al. | 340/539.13 |
| 7,030,765 | B2 * | 4/2006 | Giraldin et al. | 340/573.1 |
| 7,147,149 | B2 * | 12/2006 | Giraldin et al. | 340/572.1 |
| 7,164,354 | B1 * | 1/2007 | Panzer | 340/539.15 |
| 2002/0107947 | A1 * | 8/2002 | Moragne et al. | 709/223 |
| 2003/0097351 | A1 * | 5/2003 | Rothschild et al. | 707/1 |
| 2004/0015379 | A1 * | 1/2004 | Mee | 705/7 |
| 2004/0181676 | A1 * | 9/2004 | Lane et al. | 713/182 |
| 2004/0243542 | A1 * | 12/2004 | Meltzer | 707/1 |
| 2005/0045710 | A1 * | 3/2005 | Burke | 235/375 |
| 2005/0073407 | A1 * | 4/2005 | Giraldin et al. | 340/539.2 |

FOREIGN PATENT DOCUMENTS

GB 2293348 A * 3/1996

* cited by examiner

*Primary Examiner*—Benjamin C Lee
*Assistant Examiner*—Eric M Blount
(74) *Attorney, Agent, or Firm*—Ober/Kaler; Royal W. Craig

(57) ABSTRACT

An electronic system, for use at a facility, to immediately display notification, at a plurality of locations within the facility, that a person is missing. The system includes a portable data storage medium containing information related to a person, including an image of the person, to be carried by a guardian. The system also includes a network of stations and a system server equipped to receive the data from the portable data storage medium, in the event that the person and the guardian are separated, and to display an image of the person at a plurality of stations to assist security personnel and bystanders in locating the person. The invention also includes a method of recording information related to a person on a portable data storage medium and providing a network of stations and a system server to receive information including an image of the person and to display the image simultaneously at a plurality of locations.

13 Claims, 4 Drawing Sheets

LOST PERSON NOTIFICATION SYSTEM

CROSS-REFERENCE TO RELATED APPLICATIONS

The present application derives priority from U.S. Provisional Patent Application 60/487,552 filed: Jul. 15, 2003.

BACKGROUND OF THE INVENTION

1. Field of the Invention

The invention relates to the displaying of an image of a lost person in an emergency situation and, more particularly, to a system for rapidly decoding and displaying an electronically stored image, of a lost person, on a plurality of remotely located display devices.

2. Description of the Background

The risk of having children or disabled adults lost or abducted during a visit to a public or private place is a concern for the host, parents, guardians and other responsible persons. The risk is increased in places where large numbers of persons are moving about freely, such as airports, shopping malls, stadiums and amusement parks. Facilities having activities oriented toward children, such as sports and entertainment complexes pose a particular concern because they operate in large areas with multiple exits. Children can be manipulated or persuaded to make poor decisions which compromise their safety. Experts have reported that children abducted by certain types of perpetrators have a much greater chance of being found alive if they are found within a short period of time. In order to maximize their safety, it is desirable to quickly locate lost children.

The owners and operators of such facilities spend time and effort to provide security in the form of controlled entrances and exits, video monitoring, security employees and other measures. Presumably, the presence of well planned and implemented security measures at a particular facility acts as a deterrent against those persons having criminal intent with regard to the abduction of susceptible persons. It is an advantage to have somewhat conspicuous security measures so that visitors to the premises are aware of precautions being taken. In addition to the security measures which generally relate to monitoring activity on the premises, it is possible for responsible individuals to take steps to reduce the risk of loss or abduction, for a child or disabled person. Identification tags or badges are often attached to the person of the child or disabled person. Depending on the capabilities of the child or disabled person, the responsible person may give particular instructions in the event of an emergency and prepare a plan for a place to meet if persons become accidentally separated. Electronic systems have been developed to assist a responsible person in locating their charge. U.S. Pat. No. 5,337,041, to Friedman, discloses an audible alarm to be worn by a child, which can be activated remotely, by a guardian. Various electronic systems have been developed to rapidly communicate information in other types of emergency situations. U.S. Pat. No. 5,561,412, to Novak, discloses a hospital nurse calling system which logs patient information and automatically detects the presence of a nurse, who has responded to the call. U.S. Pat. No. 5,633,621, to McDonald discloses a system for displaying information describing the location of non-ambulatory persons within a building, when an evacuation is necessary. U.S. Pat. No. 5,686,886, to Stensey, discloses a neighbor alert system whereby a person having difficulty may send a signal indicating their location.

There remains a need for a system which can be controlled and operated by a responsible person to rapidly display notification to security personnel and to bystanders that a child or disabled person has become separated from their guardian or responsible person. Preferably, such a system would be capable of simultaneously displaying notification information near each exit of the facility and at other dispersed locations, such notification including an image of the lost person showing their clothing and their face.

SUMMARY OF THE INVENTION

It is an object of the present invention to provide a method and an electronic system for rapidly and prominently displaying a notification of a lost person, inclusive of an image of the lost person (both face and clothing), at a plurality of dispersed locations.

It is another object of the present invention to provide an electronic system which can be activated by a guardian or responsible person to transmit and display information from a medium carried and controlled by the guardian or responsible person.

It is another object of the present invention to provide a system which can rapidly and prominently display an image of a lost person near all premises exits and at other locations.

It is another object of the present invention to provide a system which maintains personal image and other data only in a medium controlled by the guardian or responsible person until the guardian or responsible person transmits the information.

In accordance with the stated objects there is provided a lost person notification method and system comprising a camera for photographing a person and for recording one or more images of the person. The system includes means for collecting and recording identifying information related to the person and to another person who is a responsible person, such as a parent or guardian. Means are provided for transferring the recorded images and identifying information to a portable storage medium. Typically, the photographs would be taken and the identifying information would be collected when a person, accompanied by a responsible person, enters the premises of a facility such as a stadium, entertainment center or shopping mall, at the commencement of a visit. If entry into the facility involves ticketing, registration or the like, the collection of recorded images and information would generally be accomplished at the same time. The portable storage medium bearing the recorded images and identifying information would be given to the responsible person and may be carried by the responsible person for the duration of the visit to the facility.

In the event that the person and the responsible person become separated during the visit to the facility, the responsible person may use the portable storage medium to notify security personnel and bystanders that assistance is needed to locate a lost person. In order to accomplish the notification, the system includes manually operable means for transferring the recorded images and information from the portable medium to a system server. It is intended that a plurality of such manually operable means would be dispersed throughout the area of the facility so that the responsible person would have quick access to such means regardless of their location within the facility. The system server has processing software and is programmed to selectively process said recorded images and identifying information in a programmed operation to log the recorded images and identifying information and to produce an output including one or more images of the person. The system also includes means for receiving and displaying said output at a plurality of remote locations simultaneously for perception by security personnel and bystanders. It is intended that the displayed output would include images showing the face and the clothing of the person and may also include an alarm sound for drawing attention to the displayed images. Security personnel and bystanders would be able to help locate the person matching the image displayed by the system.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The present invention is a notification system and method for alerting security personnel and bystanders of an emergency situation regarding a missing child or disabled person. The invention generally includes a registration subsystem as shown in FIG. 1, and a notification subsystem as shown in FIG. 2.

Figure 1:
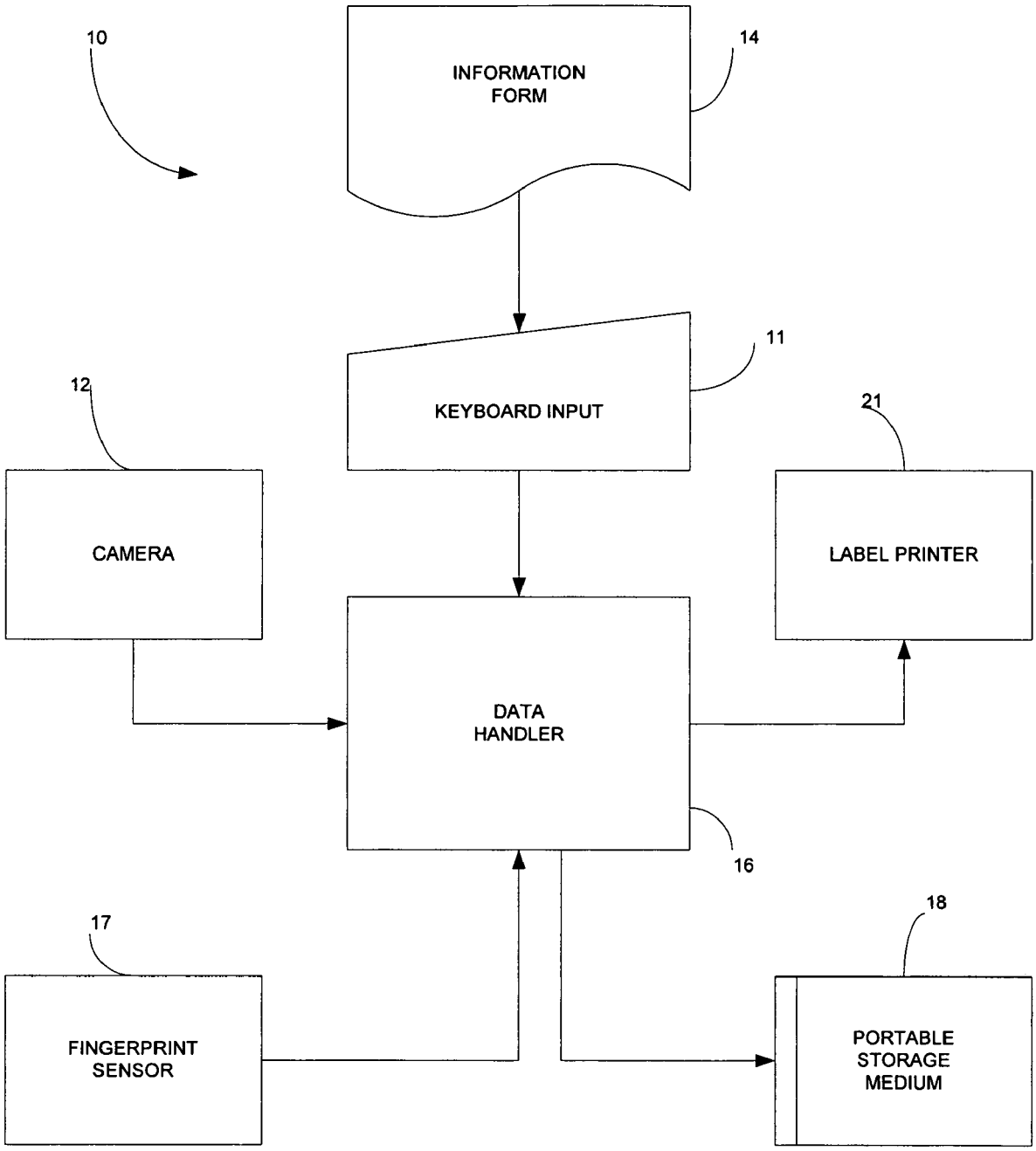
FIG. 1 is a block diagram of the registration process.
Figure 2:
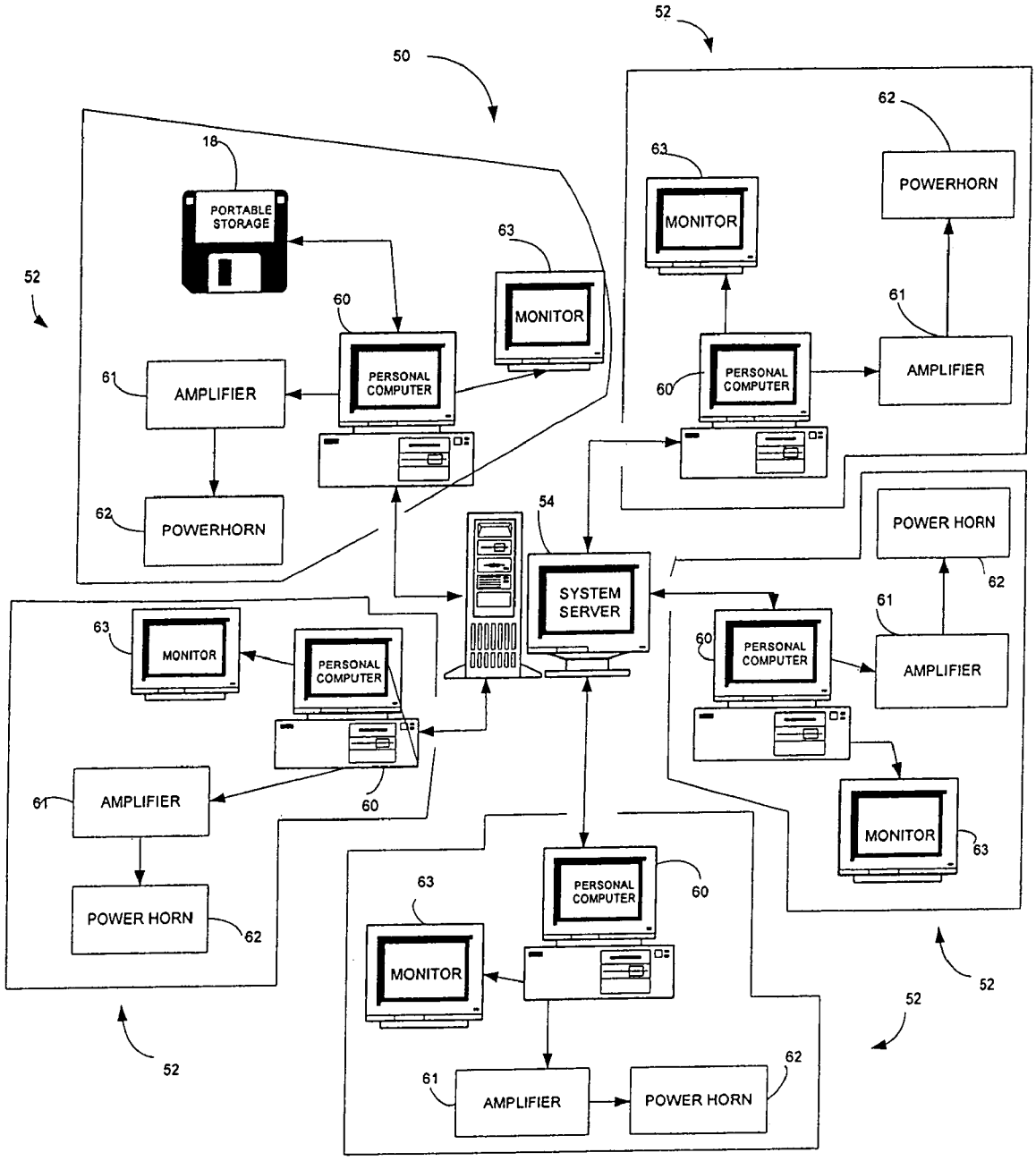
FIG. 2 is a block diagram of the emergency notification process.

Referring to FIG. 1, the registration subsystem 10 includes a digital camera 12, an information form 14, a data handler 16 and a portable storage medium 18. The registration subsystem 10 is preferably installed at facilities which receive crowds of visitors who move about freely during their visits, particularly facilities which attract children, such as at ticket booths or guest services offices. It is intended that persons visiting the facility, in the company of a supervising responsible person, such as a parent or guardian, would register for the protection offered by the system of the present invention. The camera 12 is used to photograph the person, and the information form 14 is completed to collect identifying information including name, address and phone number of the person and of their guardian, and cell telephone number if one is available. It is preferred that the photographs include a close up shot of the face and a full body shot showing the clothing being worn. In the preferred embodiment, the person's fingerprints are taken as well. The information form 14 is completed in machine readable format, and the data handler 16 includes an integrated keyboard 11 for inputting the information. A suitable camera 12 is the Intel®, Pro Video PC Camera. The identifying information is collected on the form 14 and is entered to the data handler 16 from its keyboard 11. Fingerprints may be taken in machine readable form with a fingerprint sensor 17, such as The 5$^{th}$ Sense™, Combo Peripheral manufactured by Veridicom of Sunnyvale Calif., which also includes a smart card reader. The camera 12 and the fingerprint sensor 17 are connected to the data handler 16 by conventional means, such as a standard USB cable. The NCR Easy Point™ 45 computer is a suitable data handler 16.

In operation, paper forms with identifying information 14 are provided for registration, with blanks to be filled in by the guardian. An attendant photographs the person and operates the fingerprint sensor 17 to obtain a fingerprint. The attendant enters the information from the form, through the keyboard, and the digital photograph, identifying information and fingerprint are compiled into a digital record by Data Handler 16. The record is then output and stored on a portable storage medium 18. In the preferred embodiment, the portable storage medium 18 is a conventional smart card as shown in FIG. 3, and an associated smart card reader/writer 20.

Figure 3:
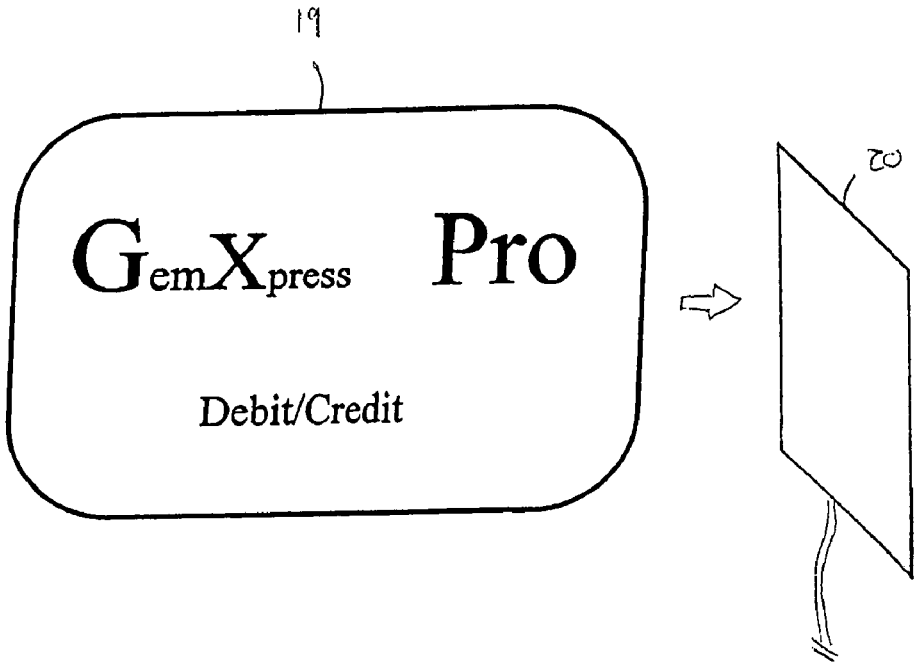
FIG. 3 is a smart card

Referring to FIG. 3, the smart card 19 is a credit card sized device which contains a microprocessor and a nonvolatile read/write memory, referred to as EEPROM (electrically erasable programmable read only memory). A suitable smart card is a GemXpresso Pro Card with 64 kB of RAM. The smart card reader/writer 20 may be the widely available Micro Innovations USB Smart Card Reader/Writer system, Mfg Part#: USB725R. The attendant inserts the smart card 19 into the smart card reader/writer 20.

Referring back to FIG. 1, Data Handler 16 includes resident software which compresses the digital photograph and fingerprint, and compiles the compressed digital photograph, identifying information and fingerprint into a digital record which is then stored on the portable storage medium 18 (e.g., on smart card 19). The size of the raw fingerprint image is 90 K bytes, which is compressed into a standard JPG format file until it occupies approximately 15 K bytes. The image from the full body shot compresses into a standard JPG file of approximately 14 K bytes. The image of the person's face is compressed until it occupies approximately 30 K bytes. The greater compression of the image of the full body shot results in some loss of detail but the image is intended only for illustration of the clothing being worn. The image of the person's face is compressed as little as possible. Together, the two JPG photograph images, the fingerprint JPG image and the text file containing identifying information are stored on the GemXpresso Pro Card 19. Standard image processing drivers are used, along with drivers provided in the CONFIRMA-EK software development package provided by Veridicom for fingerprint image extraction, and drivers in the GemXpresso RAD III Development Suite Kit from Gemplus, to interface with their smart card.

Figure 4:
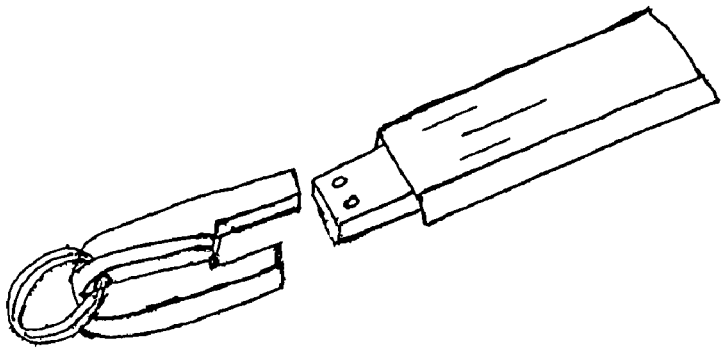
FIG. 4 is a flash drive

It is contemplated that other portable storage media 18, which have a larger capacity, may be used to reduce the amount of data compression required to be performed. A flash memory, such as the Thumbdrive™ Smart, shown in FIG. 4, manufactured by Trekstor USA of San Ramon, Calif. allows for 16 M bytes of storage. In spite of the relatively large data storage capacity, this device is small enough to be easily carried by a guardian during a visit to a facility. The use of a larger capacity portable storage medium may allow for data for more than one person to be stored on the same portable storage medium.

Once the attendant has transferred the recorded images and identifying information, the guardian may wish to reinsert the portable storage medium 18 (e.g., smart card 19) back into its reader 20 to verify the presence of the recorded images and data.

In the preferred embodiment, the data handler 16 is also provided with a label printer 21 for printing the person's name on a label, which may then be affixed to the portable storage medium 18. At the conclusion of a visit, the guardian may return the portable storage medium 18 to the attendant, to be erased and reused. It is an advantageous feature of the system that personal information is not recorded in a central memory to preserve privacy.

In the event that a guardian discovers that the person is missing, during a visit to a facility, the notification subsystem may be activated for alerting security personnel and bystanders to assist in locating the missing person.

Figure 5:
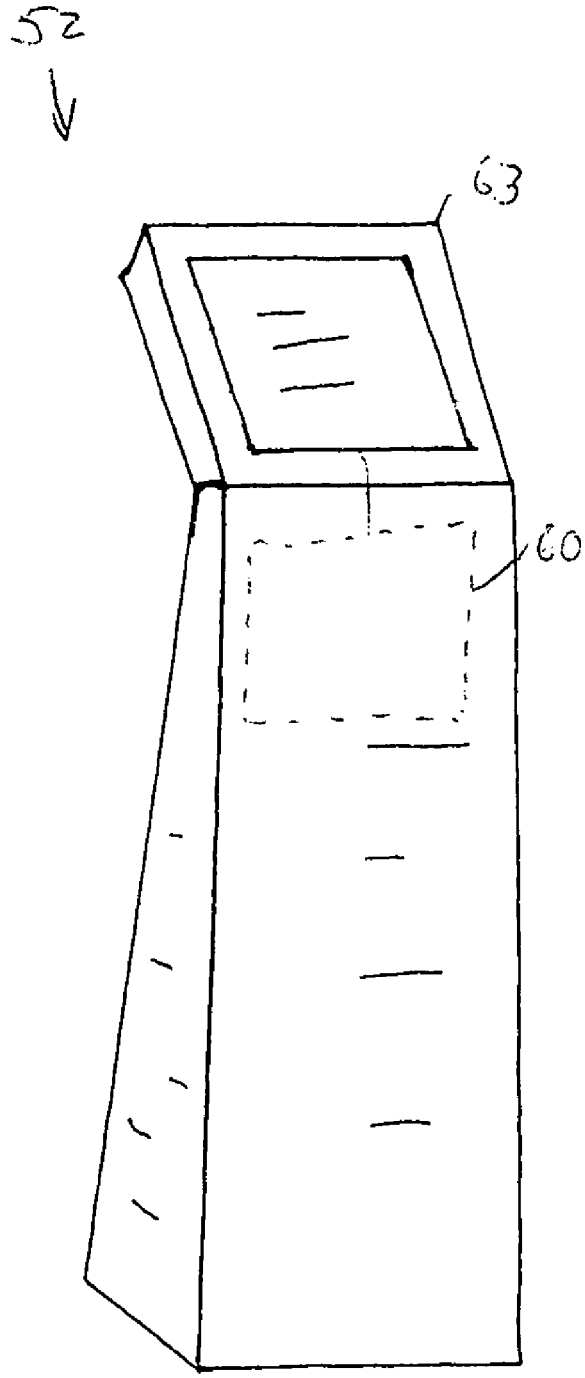
FIG. 5 is a personal computer with built-in display monitor

As shown in FIG. 2, the notification subsystem 50 components include a plurality of reporting stations 52 for retrieving the recorded images and identifying information from the portable storage medium 18 and a system server 54. Each reporting station 52 includes conventional hardware for transferring the recorded images and identifying information to the system server 54. It is contemplated that the system server 54 may have other uses not related to lost person notification and to that end, may have processing tasks running. When a portable storage medium 18 is inserted into any reporting station 52, the server 54 immediately processes the identification record stored thereon, inclusive of photograph and identifying information to produce an output which is then displayed at a plurality of locations throughout the facility. In the preferred embodiment, the reporting stations 52 are placed at locations approximately 100 feet apart so that individuals are never farther than 50 feet from one of the stations 52 and are always able to quickly access a reporting station 52. In the preferred embodiment, each reporting station 52 includes a conventional personal computer 60 with on-board audio card and a smart card reader and WiFi adapter. The smart card reader is connected to the personal computer and the output of the computer is connected to the WiFi adapter. The guardian may insert the smart card 19 containing the stored images and identifying information, into the smart card reader. The personal computer 60 is configured and programmed to detect the insertion of the smart card into the smart card reader, retrieve the stored data record and transmit it as a signal from the WiFi adapter. A suitable smart card reader is a model DT3000 from Mako Technologies, of Delray Beach, Fla. which may be connected to the personal computer by serial RS-232 cable. A suitable WiFi adapter is the MA101 802.11b Wireless USB Adapter from Netgear of Santa Clara, Calif., connected to the personal computer 60 by USB cable to the USB port of the personal computer 60. The WiFi adapter is a standard wireless protocol used for local area networks (LAN) and includes encryption protocols for security purposes. A suitable personal computer 60 is a 110 STEALTH, shown in FIG. 5, from Instruments & Equipment Co. of Sparta, N.J. It is intended that the signal transmitted from the WiFi adapter would include a marker identifying the station from which the report originated. It is possible to configure the system with a wireless smart card which can be read without requiring physical contact with the reader. If the system is configured with portable storage media 18 having data of more than one person, the card reader can be configured to include a set of buttons to provide for the selection of the data of a particular missing person for transmission to the system server.

The server 54 is equipped with a wireless access point (WAP) device (which may be integral or connected to the system server 54 by a USB port) for receiving the transmission from the WiFi adapter of personal computer 60. The system server 54 is a programmable computer which is configured and programmed to continually monitor the WAP device for incoming data signals and to immediately process any incoming signals. Processing includes logging the input and producing an output that interrupts processing tasks, decompiles the record, and outputs the associated images, identifying information and a set of control commands, from the WAP device. A suitable WAP device is the MR814 WAP from Netgear and a suitable system server is the NCR EasyPoint™ 45PC. In the preferred embodiment, the WAP device is connected to the LAN network interface of the system server 54. It is noteworthy that the functions of the system server 54 and the registration data handler 16 may be performed by a single NCR EasyPoint™ 45PC having separate software running simultaneously.

Once the system server 54 outputs the images, identifying information and control commands through the WAP device, the information is received and displayed at a plurality of stations 52 at locations throughout the facility. In the preferred embodiment, the output signal from the WAP device is received by the personal computer 60 with WiFi adapter. The display of the images and identifying information is accomplished by a video display monitor 63, a public address amplifier 61 and a power horn (speaker) 62. A suitable personal computer 60 is the 110 STEALTH, shown in FIG. 5, from Instruments & Equipment Co., which includes a built-in monitor 63. A suitable public address amplifier 61 is the model #32-2001 20W Public Address Amplifier from Radio Shack and a suitable powerhorn 62 is model #40-1440 Indoor/Outdoor Powerhorn also from Radio Shack. In order to provide the most economical system, the stations for reporting a missing person and the stations for displaying the notification are identical, as this way a single brand of personal computer and WiFi adapter serve the purposes related to reporting and displaying the notification of a missing person. The same need for dispersing the stations throughout the facility for quick access to report a missing person applies to the need for dispersing the stations for displaying the image of the missing person. In the preferred embodiment, the reporting and display functions share the use of the WiFi adapter and the personal computer. The personal computer 60 is programmed and configured to receive the image and identifying information and to respond to the commands. In the preferred embodiment, the personal computer 60 outputs a standard format WAV file comprising a siren sound stored on its hard drive. The personal computer 60 displays the image of the missing person on monitor 63 and repetitively plays the siren file and may also play a programmed announcement. In order to accomplish this function, the audio card output of the personal computer 60 is connected to the public address amplifier 61, and the amplifier's output is connected to the powerhorn 62. The immediate area surrounding the station is alerted with the siren sound and announcement, drawing attention to the image of the missing person. It is intended that all of the plurality of stations 52 would display the notification simultaneously. The image display may include the person's name. In the preferred embodiment the system server would be programmed and configured to alternate the display of images and identifying information, in the event that more than one report of a missing person is transmitted to the system server 54 and to cease the transmission of a particular report of a missing person when so instructed by appropriate manual input. It is anticipated that during times when no missing persons are being reported, the system server 54 would run normal processing tasks comprising the retrieval and transmission of marketing announcements relating to the activities being conducted at the facility or announcements of general nature. The announcements may include video and audio content. The announcements would be presented by the stations to inform visitors to the facility. However, upon receipt of a lost person notification (with image and identifying information), the rapid alert and display of the image at all of the plurality of stations greatly increases the likelihood that an abductor will abandon an attempted abduction and that a missing person will be quickly located and returned to a guardian. In the event that a missing person is not quickly located, the image, fingerprint and other information may be provided to law enforcement officials, from the system server.

Another version of the present invention may be practiced without the need for portable data storage media 18. It is contemplated that a person's standard picture identification card could be carried by a guardian. It is preferred that the system include means to produce a picture identification card, in the event that the person does not have one. This is likely if the person is a child or a disabled adult. It is preferred that the identification card be prepared with the person's name address and phone number, fingerprint image and photograph. Information for the guardian may be included as well. Conventional means are to be used to prepare the picture identification card with a fingerprint image. In the alternate version, the stations would have a standard scanner in place of the smart card reader. The scanner would be connected to the personal computer in conventional fashion. In the event of an emergency separation, the guardian would scan the identification card instead of inserting the smart card in the smart card reader. The system would operate to display an image of the identification card on the display monitors 63.

In the event that one or more of the stations 52 is outside the effective communication range of the wireless LAN, which is approximately 1500 feet when used outdoors, additional WAP devices may be connected to the personal computers 60 at a station or stations within the range and the additional WAP devices may be configured to relay the signals to and from the stations 52 which are out of range. It is also possible to use standard wired communication means, such as standard wired LAN and powerline data means, in place of the wireless system disclosed herein, to connect the stations 52 to the system server 54 which may be preferable for some applications. Although the preferred embodiment includes digital communication means, it will be apparent to those skilled in the art that analog communication may be used to serve the purposes of the present invention, without departing from the spirit of the invention. Other alterations and modifications will be suggested to those skilled in the art and it is understood that all such variations, modifications and changes are intended to come within the scope of the invention as disclosed and claimed herein.

We claim:

1. A method for alerting security personnel and bystanders that a person is missing using a computer network including a plurality of reporting stations each including a display and a powerhorn, and a plurality of registration stations each including a camera and fingerprint scanner, and a network server in wireless communication with all of said reporting stations and registration stations, comprising the steps of:

collecting registration information from a person at one of said registration stations, said collecting further comprising the substeps of, photographing one or more images of a person using said camera;

obtaining a fingerprint of said person from said fingerprint scanner;

converting said fingerprint to a digital record;

recording said images and digital fingerprint record electronically;

collecting and recording identifying information related to said person and a guardian or responsible person;

transferring said identifying information and said recorded images to a portable storage medium;

transferring said recorded images and identifying information to said system server;

receiving notification that said person is missing;

upon receipt of said lost person notification, broadcasting said images and digital fingerprint to all of said plurality of reporting stations, displaying said images to the general public on the display of all said reporting stations whilst simultaneously announcing an alert on the powerhorn in hope that said public will locate and return the lost person to said guardian or responsible person; and providing said fingerprint to proper authorities if said lost person is not returned.

2. The method for alerting security personnel and bystanders that a person is missing of claim 1, further comprising the step of printing a label at the registration station bearing the identifying information related to said person and attaching said label to said portable storage medium.

3. The method for alerting security personnel and bystanders that a person is missing of claim 1, further comprising the step of erasing the data from the portable storage media.

4. A lost person notification system for alerting security personnel and bystanders that a person is missing comprising:

a plurality of reporting stations each including a computer, display and powerhorn;

a portable storage medium;

a plurality of registration stations each including a computer, camera for photographing and recording one or more images of a person, and personal identification forms, said plurality of registration stations recording said one or more images and identifying information from said personal identification forms to said portable storage medium, and data handler software resident on a system server;

whereupon reading of the portable storage medium by any of said plurality of reporting stations prompts a notification of alert in which said one or more images and identifying information are communicated to all of said plurality of reporting stations and the display and powerhorn of all of said plurality of reporting stations are immediately and instantaneously activated to sound and display said one or more images and identifying information.

5. The lost person notification system of claim 4 wherein said data handler software comprises:

a data collection module;

data compression software a database; and a data transfer module.

6. The lost person notification system of claim 5 wherein said data compression software compresses a fingerprint scan and full-body photograph images into smaller records than the face photograph image.

7. The lost person notification system of claim 4 further comprising a public address amplifier.

8. The lost person notification system of claim 4 further comprising a smart card reader.

9. The lost person notification system of claim 4 wherein said portable storage medium is a conventional smart card and associated smart card reader.

10. The lost person notification system of claim 4 wherein said portable storage medium is a flash memory.

11. The lost person notification system of claim 4 wherein said registration stations further include a label printer.

12. The lost person notification system of claim 4 wherein said network protocol is a standard wireless protocol.

13. The lost person notification system of claim 4 further comprising a wireless access point (WAP) device.

* * * * *

UNITED STATES PATENT AND TRADEMARK OFFICE

CERTIFICATE OF CORRECTION

PATENT NO. : 7,495,571 B2
APPLICATION NO. : 10/767592
DATED : February 24, 2009
INVENTOR(S) : Charen et al.

It is certified that error appears in the above-identified patent and that said Letters Patent is hereby corrected as shown below:

On the Title Page Delete Item (12) "Charren et.al." and Insert Item (12) --Charen et. al.--

On the Title Page Item (76) Please Delete "Charren" and Insert --Charen--

Signed and Sealed this

Thirty-first Day of March, 2009

JOHN DOLL
*Acting Director of the United States Patent and Trademark Office*